US005469980A

United States Patent [19]

O'Meara et al.

[11] Patent Number: 5,469,980

[45] Date of Patent: Nov. 28, 1995

[54] CHILD RESISTANT CONTAINER CLOSURE ASSEMBLY

[75] Inventors: John R. O'Meara, Jamesburg; David R. Cistone, Millville, both of N.J.; Louis Travalent, Jr., Lee's Summit, Mo.

[73] Assignee: Wheaton Holding, Inc., Wilmington, Del.

[21] Appl. No.: 188,596

[22] Filed: Jan. 26, 1994

[51] Int. Cl.[6] ..... B65D 51/22

[52] U.S. Cl. ..... 215/228; 215/250; 215/303; 215/321; 220/278; 222/83

[58] Field of Search ..... 215/32, 226, 228, 215/250, 253, 301, 303, 317, 321; 220/277, 278; 222/81, 83

[56] References Cited

U.S. PATENT DOCUMENTS 4,614,437 9/1986 Buehler ..... 366/130
5,052,589 10/1991 O'Meara ..... 222/83

*Primary Examiner*—Stephen P. Garbe
*Attorney, Agent, or Firm*—Eugene E. Renz, Jr.

[57] ABSTRACT

A container-closure assembly comprising a container having a nozzle portion with a puncturable diaphragm defining a discharge opening and a closure of generally of cup-like form positionable over the nozzle and having a piercing element recessed in the closure of a predetermined axial length less than the diameter of the piercing portion.

12 Claims, 11 Drawing Sheets

CHILD RESISTANT CONTAINER CLOSURE ASSEMBLY

FIELD OF THE INVENTION

The present invention relates to child resistant container-closure assemblies and more specifically to improvements facilitating precise activation of the container when it is desired to withdraw the contents.

BACKGROUND OF THE INVENTION

Container-closure assemblies of the type to which the present invention relate typically comprise a container made of plastic having a nozzle portion with a puncturable diaphragm defining a discharge opening and a closure or cap having a piercing element selectively engageable in the diaphragm to form a discharge opening when it is desired to remove the contents of the container. Container-closure assemblies of this general type are not new per se. For example, the patents listed below show container-closure assemblies of this general type:

1. John R. O'Meara UNIT DOSE CONTAINER WITH CAPTIVE CAP U.S. Pat. No. 4,765,518 Issue Date: Aug. 23, 1988

2. John R. O'Meara CHILD RESISTANT CAP U.S. Pat. No. 4,867,326 Issue Date: Sep. 19, 1989

3. John R. O'Meara CONTAINER AND CLOSURE ASSEMBLY U.S. Pat. No. 4,884,703 Issue Date: Dec. 5, 1989

4. John R. O'Meara UNIT DOSE ASSEMBLY U.S. Pat. No. 5,042,690 Issue Date: Aug. 27, 1991

5. John R. O'Meara UNIT DOSE ASSEMBLY U.S. Pat. No. 5,052,589 Issue Date: Oct. 1, 1991

6. Deusen U.S. Pat. No. Issue Date:

These patents have certain disadvantages and drawbacks. It has been found that a drawback in these prior assemblies is a phenomenon referred to as "spurting" which results in loss of product from the container during the diaphragm piercing step. More specifically, it has been found that the force needed to disengage the locking rib in the prior art assemblies to move the cap downwardly in a direction to pierce the diaphragm requires the user to exert a strong grip on the container or squeeze it excessively to produce a reaction force counteracting the applied force needed to puncture the diaphragm. Further, it has been found that in the assemblies where the piercing element is on another portion of the closure, unless it is applied in a truly axial direction, the piercing element tends to engage the thick wall portion of the nozzle surrounding the diaphragm which increases the force necessary by the user in the puncturing process.

SUMMARY OF THE INVENTION

The present invention provides an improved container-closure assembly which obviates the problems in the prior art noted above. The present invention is characterized by novel features of construction and arrangement facilitating application of the closure during the piercing process with a minimum force requirement and thereby obviates the problem of "spurting." Further, the particular configuration of the piercing element is such that even if the closure piercing element is presented at a slight angle to the axis of the container, the piercing element is nevertheless directed to the diaphragm when it is moved in a direction to apply it to the nozzle. In other words, the assembly of the present invention is self aligning and is characterized by minimum contact between the parts and thus produces very minimal, low friction during the piercing process. Essentially, the major force during the piercing process is that of sharpened piercing element engaging the diaphragm.

BRIEF DESCRIPTION OF THE DRAWINGS

These and other objects of the present invention and the various features and details of the operation and construction thereof are hereinafter more fully set forth with reference to the accompanying drawings, where.

DETAILED DESCRIPTION OF THE PREFERRED EMBODIMENT

Figure 1:
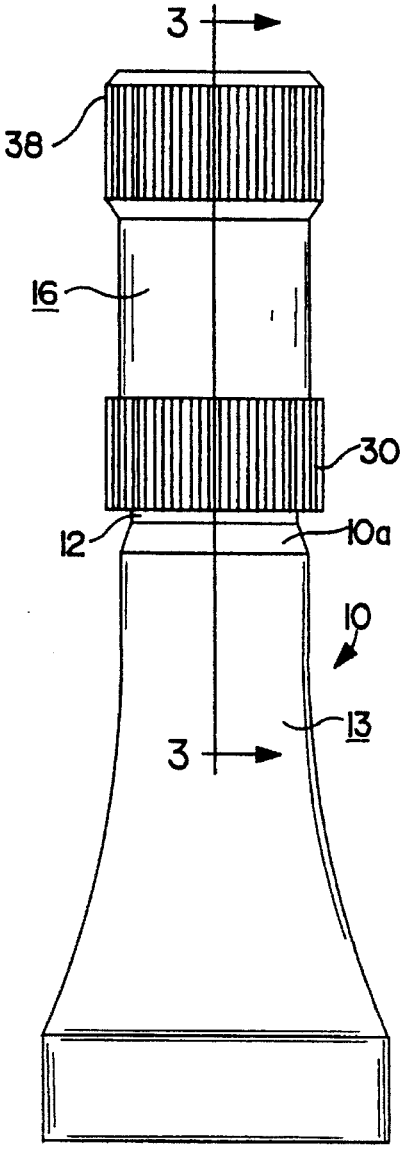
FIG. 1 is a side elevational view of a container-closure assembly in accordance with the present invention.

Referring now to the drawings and particularly to the embodiment of the invention illustrated in FIGS. 1–11 inclusive, there is illustrated a container-closure assembly in accordance with the present invention. The container designated by the numeral 10 is a unit dose tube for medicaments having an elongated nozzle 12 at one axial end and a piercable diaphragm 14 in its outer axial end face to define a discharge opening for discharging medicaments when desired.

The closure generally designated by the numeral 16 comprises a cap portion 18 and a diaphragm piercing portion 20. The cap portion 18 and piercing portion 20 are of generally cylindrical shape and are separated by a center wall 22. The cap portion 18 is of a predetermined length L to overlie the nozzle 12 when applied thereto in a sealing condition shown in FIG. 3. Inner engaging locking means is provided on the nozzle 12 and cap portion 18 for normally seating the cap portion and providing a child resistant feature. In the present instance, the locking means comprises a circumferentially extending, radially outwardly directed locking ring 24 spaced upwardly from the juncture of the nozzle 12 and body portion 10$^a$ of the container. A circumferentially extending locking groove 26 is provided on the interior wall of the cap portion 18 adjacent its lower terminal edge which snap fits over the locking ring 24 to retain the parts in the position shown in FIG. 3. The inner edge of the cap portion 18 is bevelled outwardly as at 28 to facilitate assembly of the cap portion 18 over the locking ring 24 by simply pressing the cap portion 18 downwardly during the assembly process. The exterior wall of the cap portion 18 is knurled as at 30 to facilitate assembly and removal of the cap portion by a user.

The piercing portion 20 of the closure is of cup-like configuration and is of a shorter axial length $L_p$ than the diameter D of the pocket and includes a piercing element 34 centrally located in the center wall 22 having a biased or slanted cutting edge 36. The exterior of the cap portion 18 is also knurled as at 38 to facilitate handling by a user during manipulation of the cap through various operations.

Figure 3:
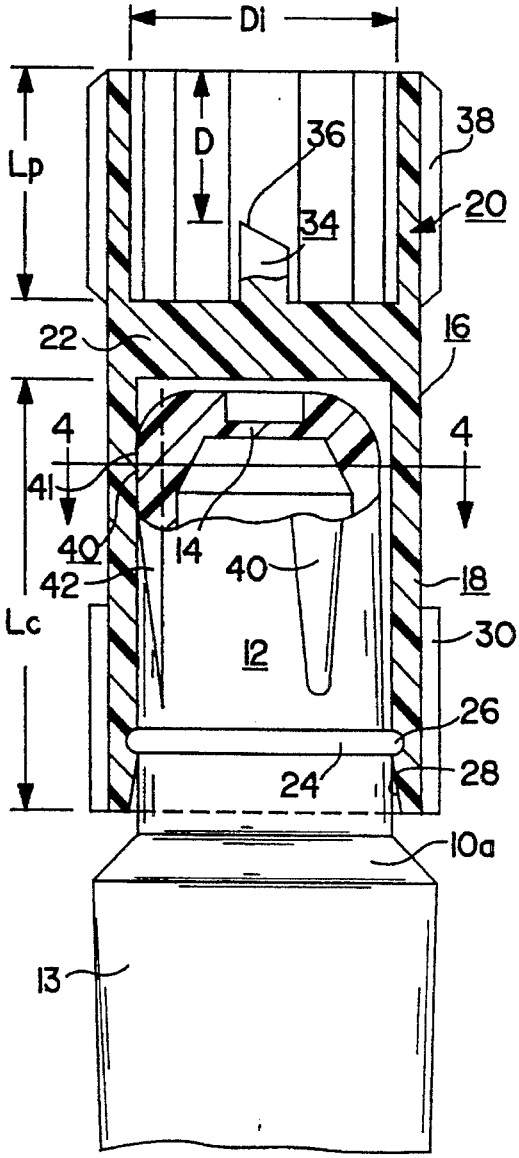
FIG. 3 is an enlarged fragmentary sectional elevational view taken on the lines 3—3 of FIG. 1 showing details of the closure and nozzle of the closure assembled in a shelf storage mode.
Figure 2:
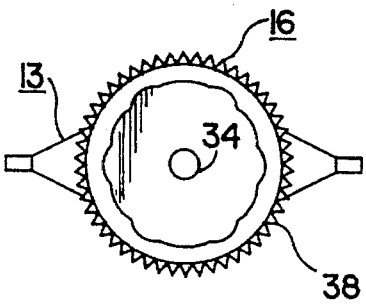
FIG. 2 is a plan view of FIG. 1.
Figure 4:
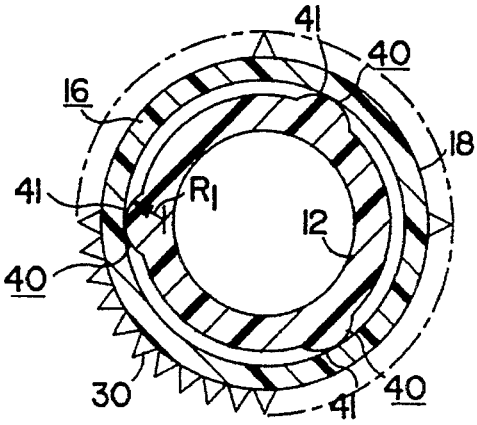
FIG. 4 is a sectional plan view taken on the lines 4—4 of FIG. 3 showing additional details of the closure and nozzle.
Figure 5:
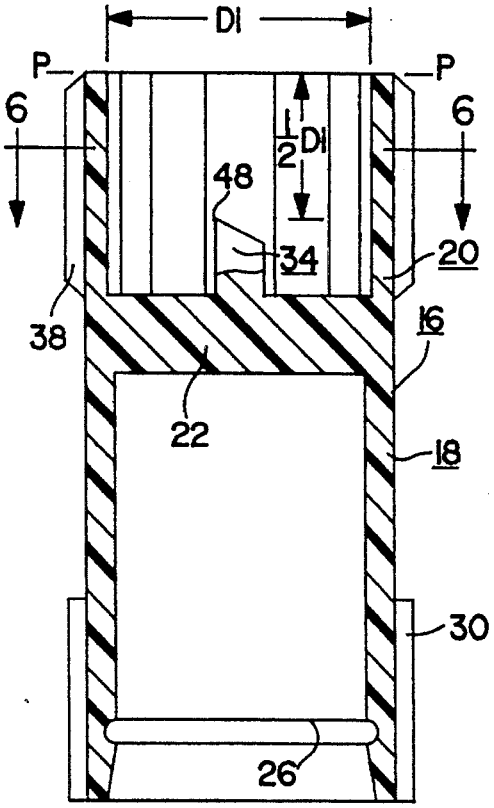
FIG. 5 is an enlarged sectional elevational view of the closure showing the desired dimensions of the pierce point tip recessed within the closure.
Figure 6:
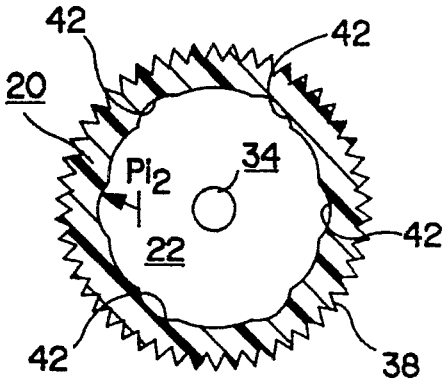
FIG. 6 is a sectional view taken on lines 6—6 of FIG. 5.
Figure 7:
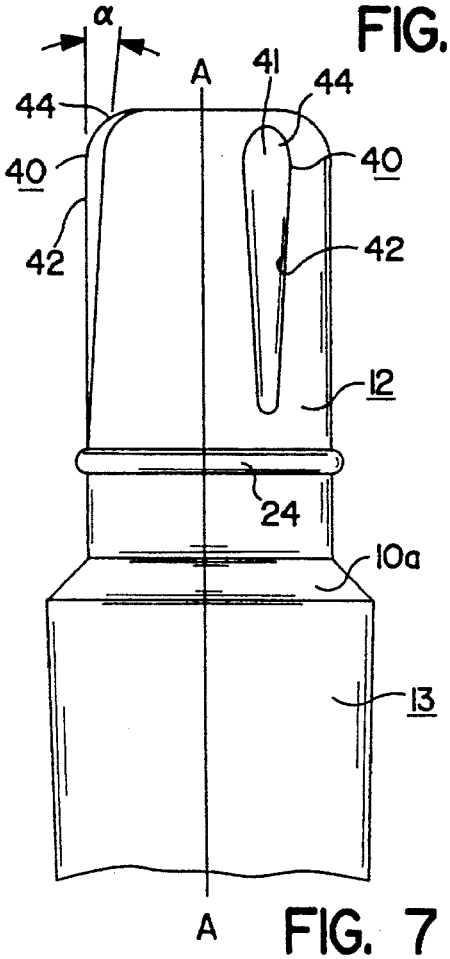
FIG. 7 is a side elevational view of the container nozzle.
Figure 8:
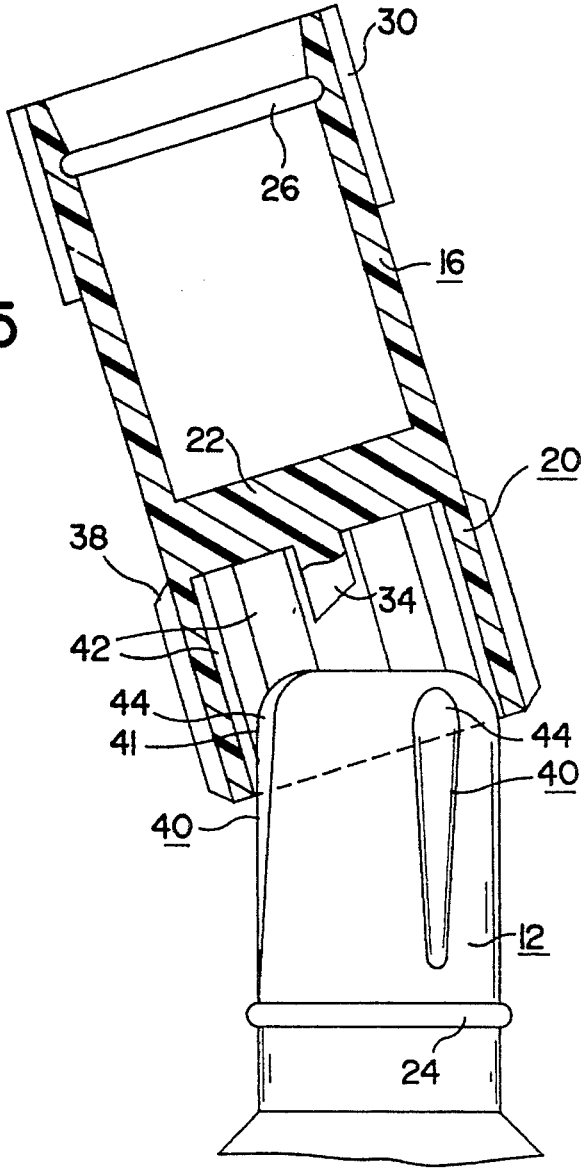
FIG. 8 is an enlarged fragmentary view with the closure in section illustrating the closure being applied to the nozzle but not aligned with the container nozzle.
Figure 9:
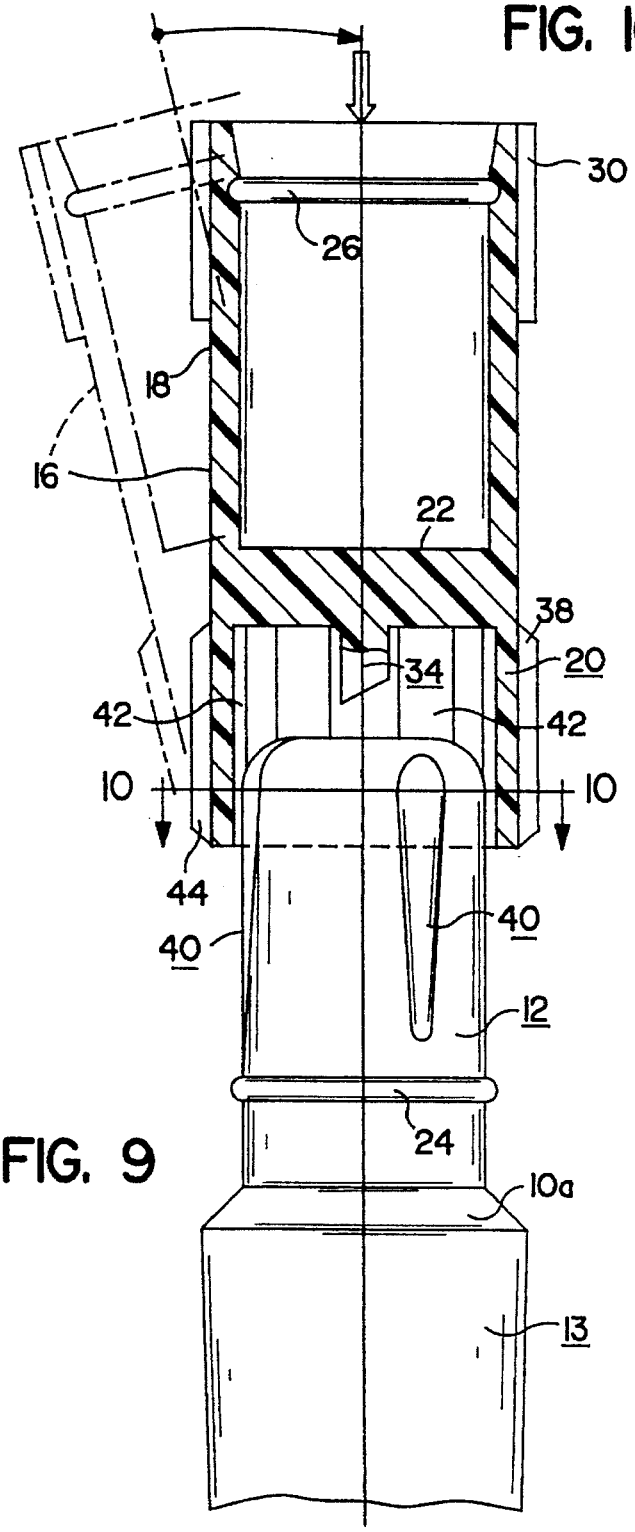
FIG. 9 is a view similar to FIG. 8 showing that the closure pivoted about one of the arcuately faced ribs positioning the closure in axial alignment with the nozzle axis.

In accordance with the present invention, means is provided for insuring activation of the diaphragm 14 by the piercing element 34 over a wide angle of entry range of the piercing portion toward the nozzle as illustrated, for example, in FIGS. 8 and 9. To this end, the nozzle is provided with a series of circumferentially spaced, longitudinally extending ribs 40. The ribs 40 are preferably of a tear drop shape so that lower portion of the ribs 40 bevel downwardly and inwardly at a predetermined angle $\alpha$ relative to the central axis A—A of the nozzle. The enlarged end of each rib 40 as shown in FIG. 7 is also rounded as at 44. The ribs thus have a curved outer peripheral shape including a radius $R_1$ at a point of maximum engagement with the inner walls of the piercing portion 20 of the closure. It is noted that the apex point 41 of the ribs engages the interior wall of the cap portion as best illustrated in FIGS. 3 and 4 to reduce friction upon application of the cap to the nozzle 12 and stabilize the cap portion in the fully seated position shown in FIG. 3. The ribs 40 engage in the grooves or trackways 42 during application of the piercing portion 20 of the cap to the nozzle 12 in the manner shown in FIGS. 8 and 9 and function to align the cap portion 18 axially with the nozzle for accurate penetration of the piercing element 34 to puncture the diaphragm 14. This arrangement avoids misalignment of the piercing element 34 to the thicker part of the nozzle which may urge the user to apply excessive force which in turn increases the possibility of "spurting" caused by excessive squeezing of the tube during the piercing operation. The rib 40 and groove 42 arrangement also provides a degree of child resistance since alignment of the groove 42 and ribs 40 is necessary to full seating of the piercing element 34 to penetrate the diaphragm. Further the rib and groove arrangement, particularly the arcuate configuration of the grooves reduces friction during assembly of the closure. In this regard, the radius $R_1$ of the ribs is smaller than the radius $R_2$ of the grooves to produce the lower friction and point contact between the parts during a piercing operation. The closure is preferably provided with six circumferentially equi-spaced grooves 42 reducing the rotation needed to align the nozzle to an axial piercing position.

In accordance with the present invention, the piercing portion of the closure is designed to prevent engagement of the piercing element 34 with other portions of the nozzle during initial application of the closure 16 regardless of the initial angle of entry. This insures axial alignment of the piercing point 36 with the diaphragm 14 before engagement of the diaphragm the piercing element to puncture the diaphragm 14. To this end, the tip 48 of the piercing element is spaced inwardly from a plane P—P through the lower terminal edge of the piercing portion, a predetermined distance D equal to at least ½ the inner diameter $D_i$ of the piercing portion 20 of the closure.

Figure 10:
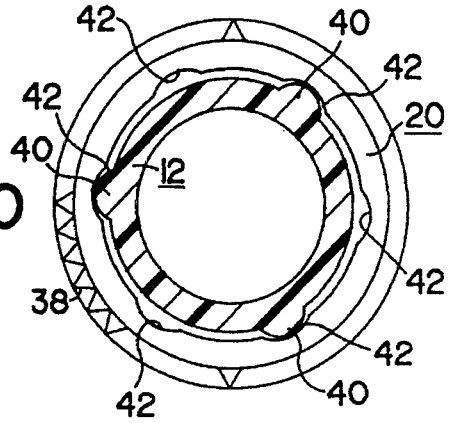
FIG. 10 is an enlarged sectional plan view taken on lines 10—10 of FIG. 9.
Figure 11:
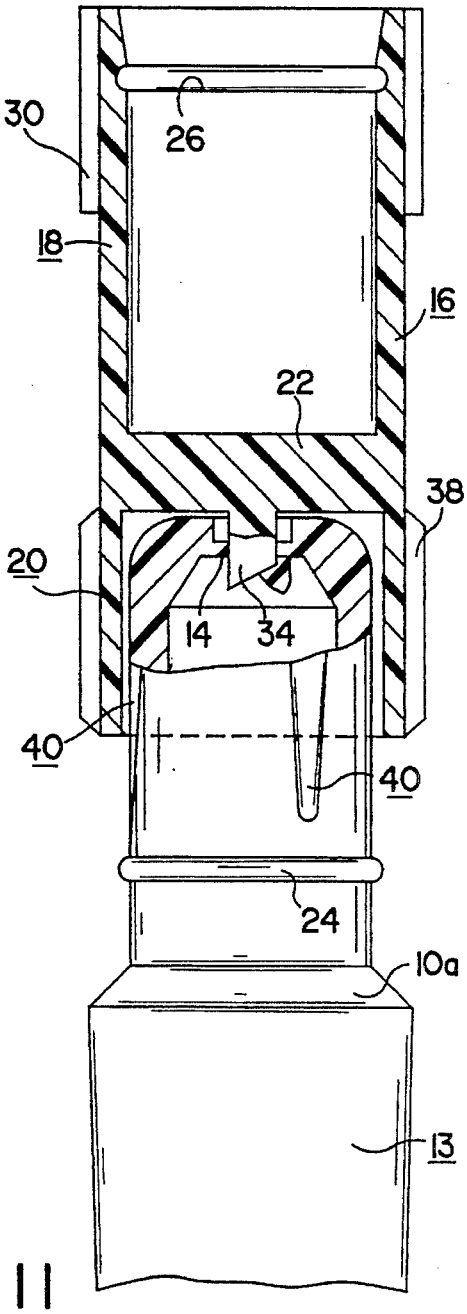
FIG. 11 shows the closure moved downwardly in the diaphragm piercing position.
Figure 12:
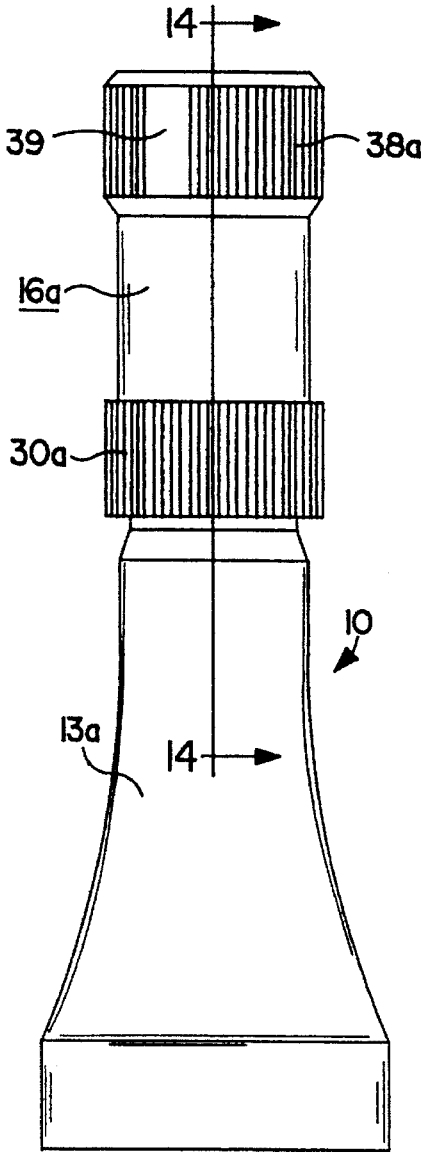
FIG. 12 is a side elevational view of another embodiment of container-closure assembly in accordance with the present invention.
Figure 14:
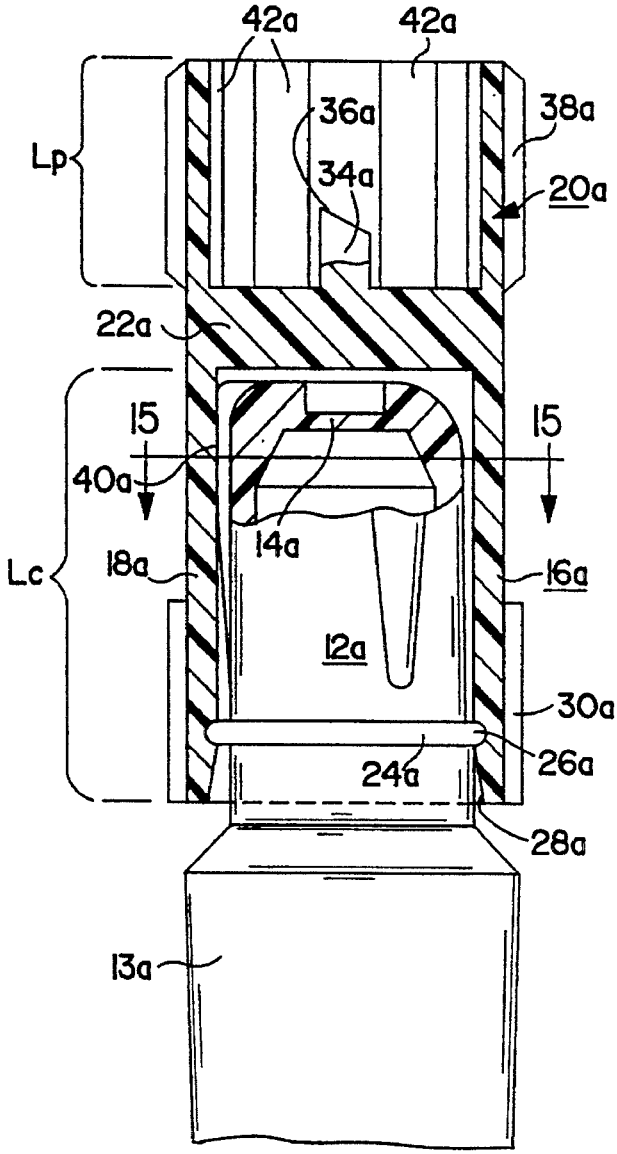
FIG. 14 is a fragmentary side elevational view taken on lines 14—14 of FIG. 12.
Figure 13:
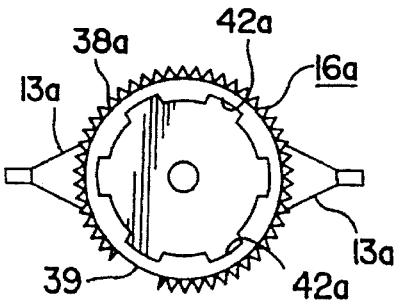
FIG. 13 is a top plan view of the embodiment shown in FIG. 12.
Figure 15:
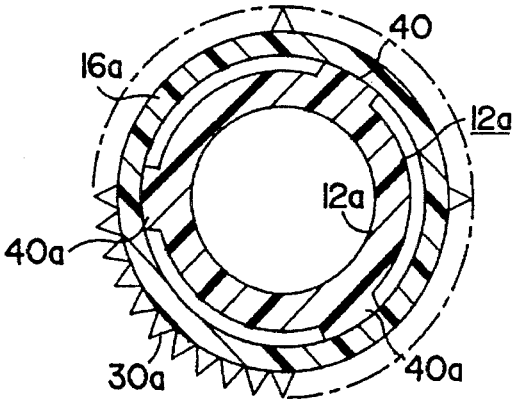
FIG. 15 is an enlarged plan sectional view taken on lines 15—15 of FIG. 14.
Figure 16:
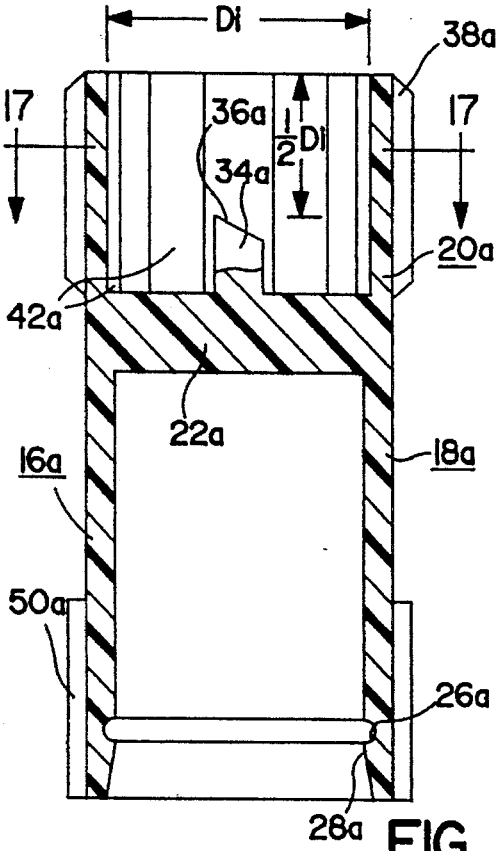
FIG. 16 is a transverse sectional view of the piercing closure member.
Figure 17:
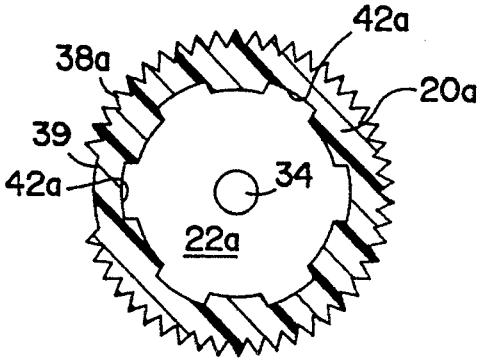
FIG. 17 is a sectional plan view taken on the line 17—17 of FIG. 16.
Figure 19:
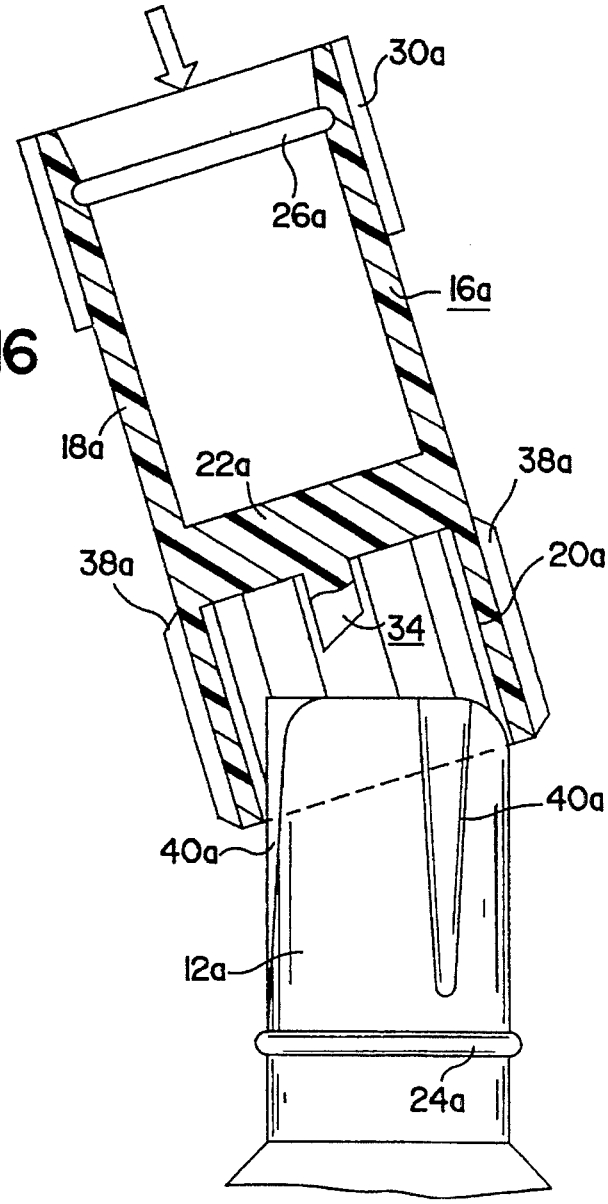
FIG. 19 is an enlarged fragmentary elevational view showing the piercing element applied to the nozzle at an angular disposition.
Figure 18:
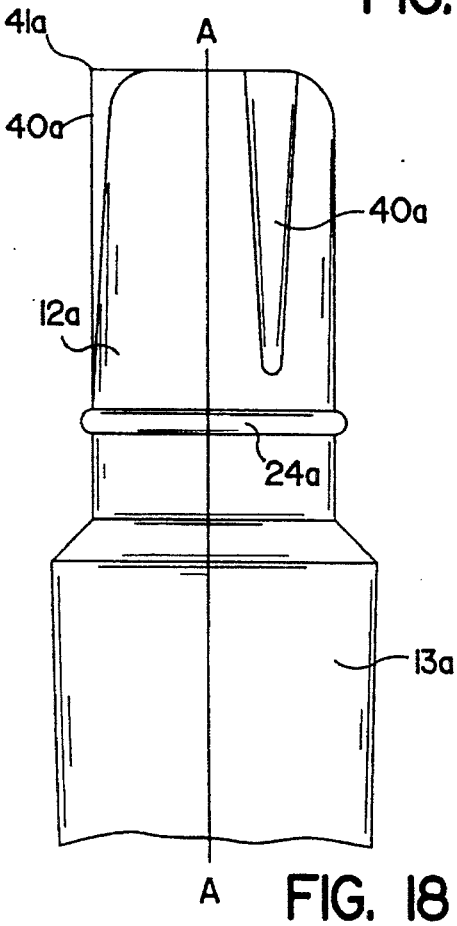
FIG. 18 is a fragmentary elevational view of the nozzle portion of the container.
Figure 20:
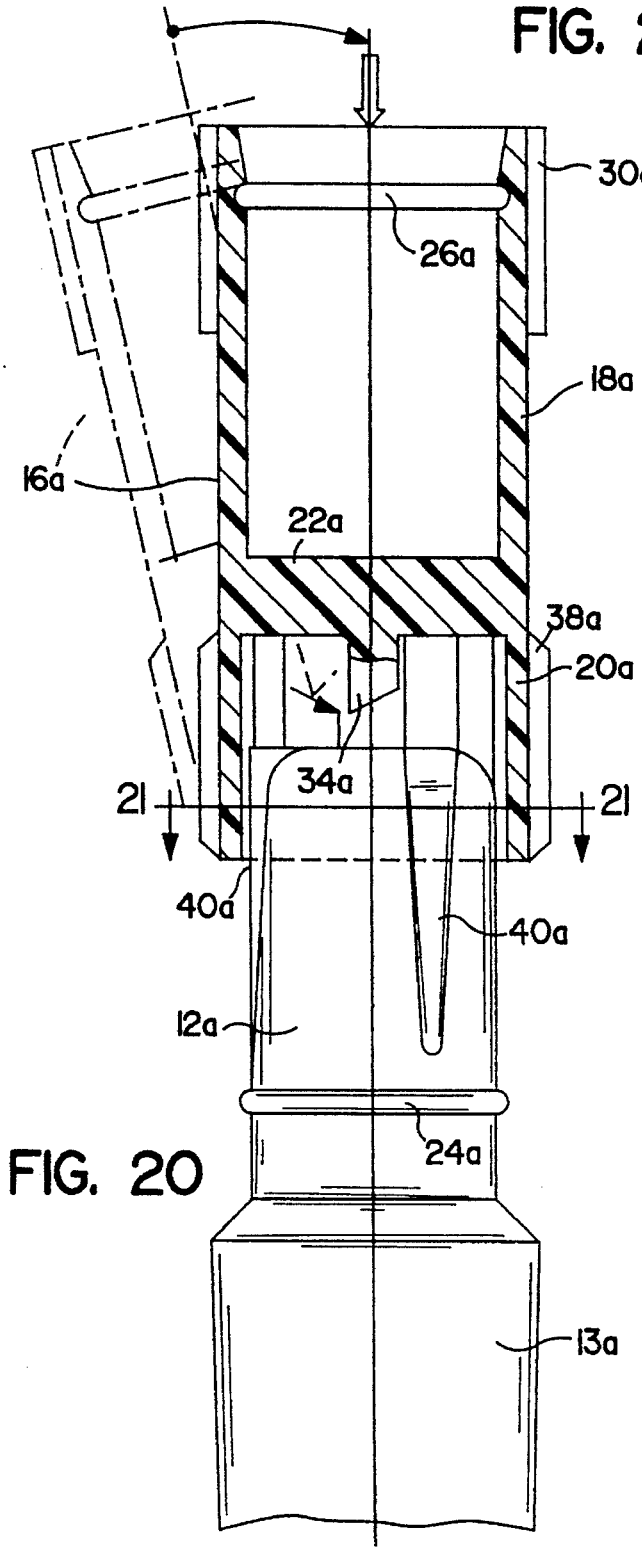
FIG. 20 is a view similar to FIG. 19 showing the axial orientation of the cap on the nozzle.
Figure 21:
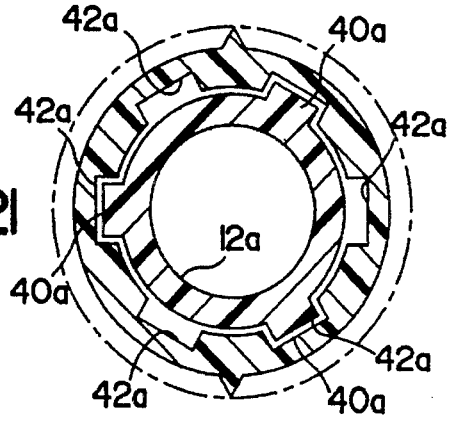
FIG. 21 is a sectional view taken on lines 21—21 of FIG. 20.
Figure 22:
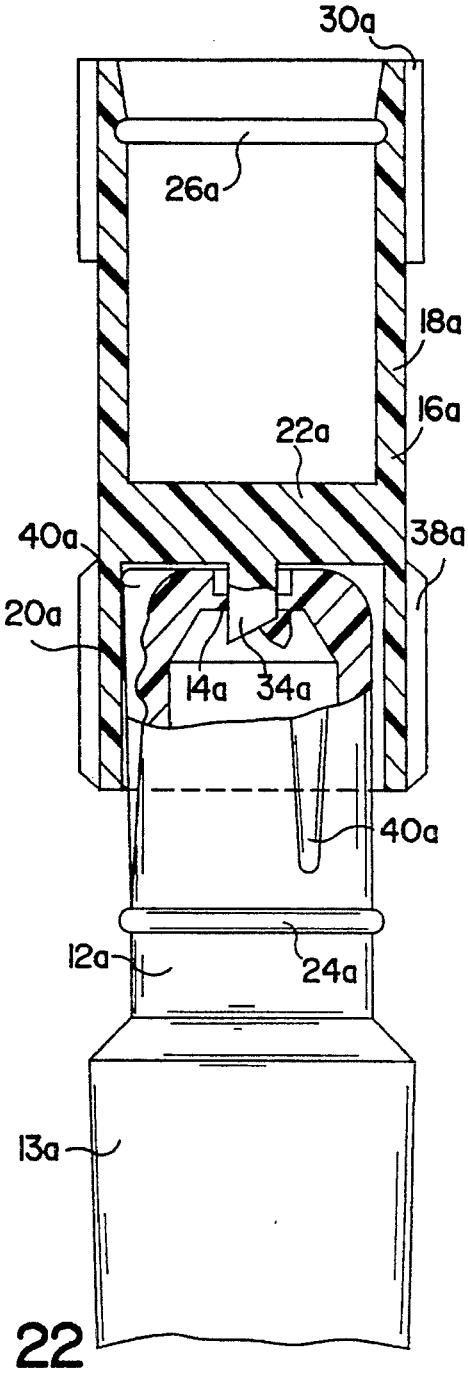
FIG. 22 is a view similar to the previous two views showing the cap fully seated in the piercing diaphragm position.
Figure 23:
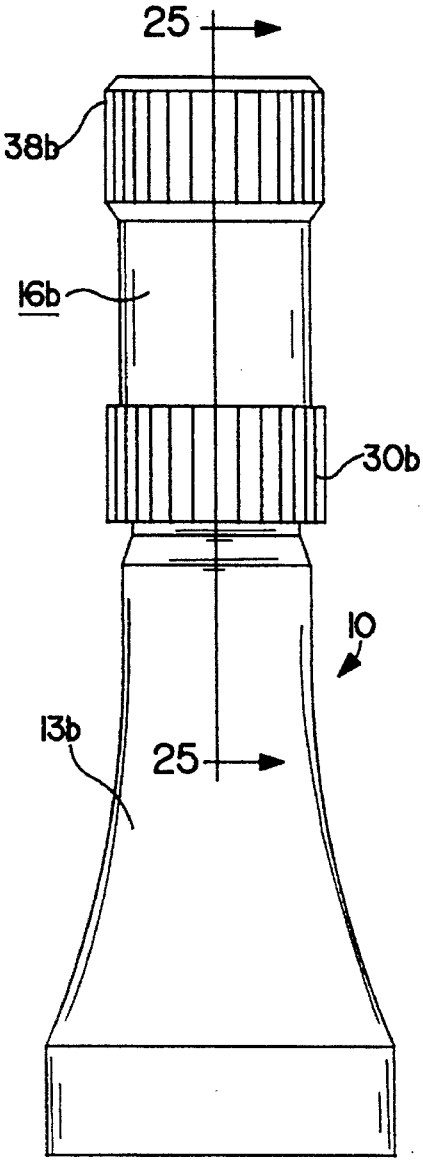
FIG. 23 is a side elevational view of still another embodiment of container-closure assembly in accordance with the present invention.

It is noted that the interior side wall of the piercing portion 20 snugly embraces the nozzle 12 for proper guidance and yet as shown in FIG. 10 has a small clearance to provide the low friction point contacts during assembly and disassembly of the piercing portion to the nozzle. This relationship provides the desired functional advantages discussed in a piercing portion of minimum height to enhance the cosmetics of the closure assembly.

Consider now briefly the use of a container-closure assembly in accordance with the present invention. Typically, the unit dose tubes have an open lower end for filling the product and are pinch sealed after being filled by automatic processing equipment. The closure 16 is then applied with the cap portion seated over the nozzle in the manner shown in FIG. 3. As pointed out previously, the locking ring 24 and groove 26 arrangement provides a degree of child resistancy to the assembly. Further, the engagement of the ribs with the inner side wall of the cap portion at the apex of the ribs centers the closure on the tube. In other words, the closure is centered on the same axis as the tube axis. Now, when it is desired to dispense the contents of the tube, the user simply withdraws the closure axially and reverses the closure so that the piercing portion faces downwardly over the nozzle. The piercing portion is rotated slightly if necessary to align the ribs in the grooves and by simply urging it axially over the nozzle automatically aligns itself axially to position the piercing element in alignment with the diaphragm. This obviates the problem of cockeyed application of the piercing portion to the nozzle which could result in the user attempting to pierce the thick walled portion surrounding the diaphragm. This is particularly important in nursing applications where the systems are activated sometimes in a dimly lit area. As pointed out previously, the rib and groove configuration provides minimum contact areas between the piercing portion and nozzle thereby reducing friction during the piercing process. This also permits a gentle holding force minimizing the "spurting" phenomenon resulting from occasion by squeezing the tube with a large force during the penetration operation.

There is shown in FIGS. 12–22 another embodiment of child resistant container-closure assembly in accordance with the present invention. The basic components of this assembly are the same as the previously described embodiment. Like parts are designated with the same numeral with an "$^a$". Thus, the assembly includes a container 13$^a$ having a nozzle portion 12$^a$ with a puncturable diaphragm 14$^a$ defining a discharge opening. The closure is an elongated tubular member 16$^a$ having a piercing portion 20$^a$ of cup like form and a cap portion 18$^a$ at 21$^a$. The piercing portion has a piercing element 34$^a$ projecting from the center wall 22$^a$. In accordance with this embodiment, the preferred axial distance D to the tip of the piercing member from the open end of the portion is preferably at least ½ the inner diameter $D_i$ of the piercing portion 20$^a$.

In accordance with this embodiment of the invention, the circumferentially spaced ribs 40$^a$ on the nozzle portion of the closure 12$^a$ are of square cross section. The ribs 40$^a$ taper gently and downwardly merge with the nozzle in the manner shown in FIG. 18 and have a slightly rounded upper edge as at 41$^a$. The piercing portion 20$^a$ of the closure is provided with a series of circumferentially spaced, axially extending recesses defining pockets 42$^a$ and are of a complementary square cross section to snugly embrace the ribs 40$^a$ which as indicated above are also of square cross section.

The exterior circumferential wall of the piercing portion is knurled as at 38$^a$ and in the present instance has a gap 39 in the knurling located adjacent one of the grooves 42$^a$ which defines indicia for aligning the grooves with the ribs when applying the piercing portion to the nozzle of the container.

There is shown in FIGS. 24–29 still another embodiment of container as closure assembly in accordance with the present invention. The basic elements of this assembly are similar to those described previously and accordingly similar parts are designated by the same numeral with a letter "$^b$". Thus, the container has an elongated nozzle 12$^b$ at one axial end having a piercable diaphragm 14$^b$ defining a discharge opening. The closure generally designated by the numeral 16$^b$ comprises a cap portion 18$^b$ and a diaphragm piercing portion 20$^b$.

In accordance with this embodiment of the invention, the tip of the piercing element 40$^b$ is spaced downwardly a distance D from the open end of the piercing portion in a predetermined relation to the internal diameter and is preferably at least ½ $D_i$ as in the previously described embodiments. This provides the functional advantages noted above in the application of the piercing portion of the cap to puncture the diaphragm 14$^b$.

Figure 25:
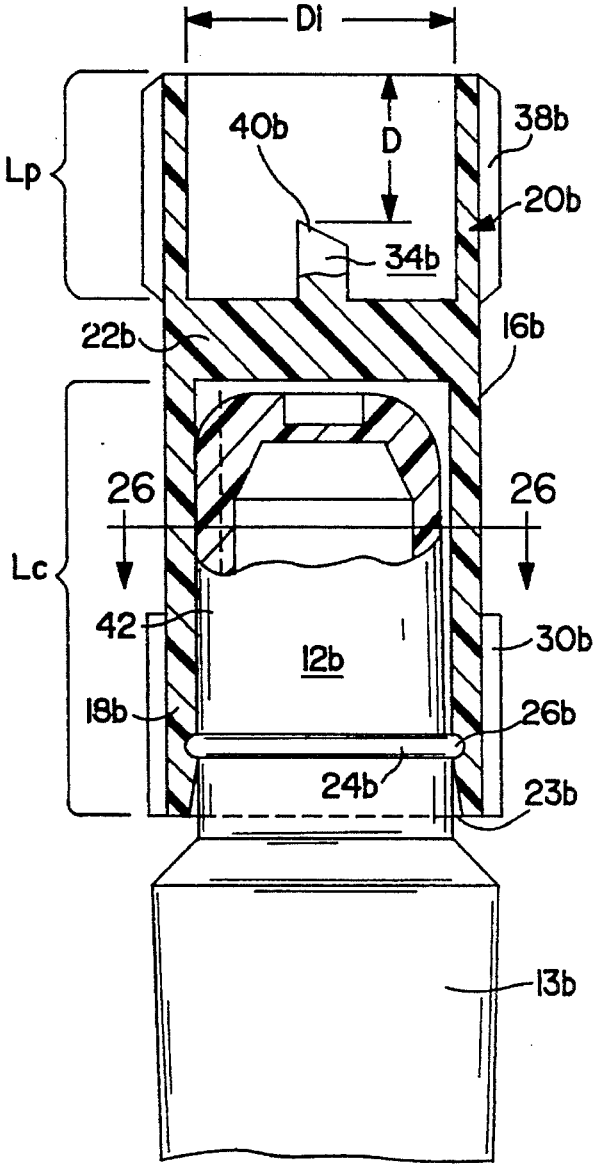
FIG. 25 is a fragmentary side elevational view taken on lines 25—25 of FIG. 23.
Figure 24:
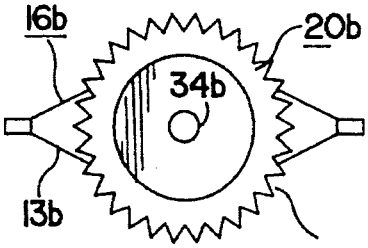
FIG. 24 is a top plan view of the embodiment shown in FIG. 23.
Figure 26:
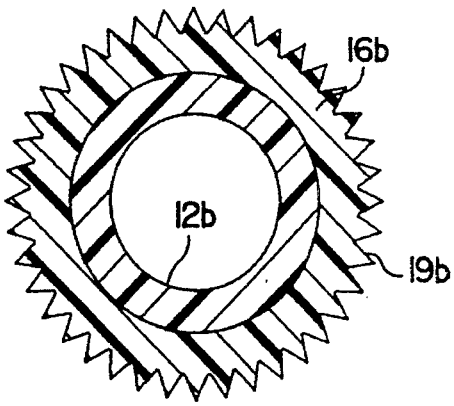
FIG. 26 is an enlarged plan sectional view taken on lines 26—26 of FIG. 25.
Figure 27:
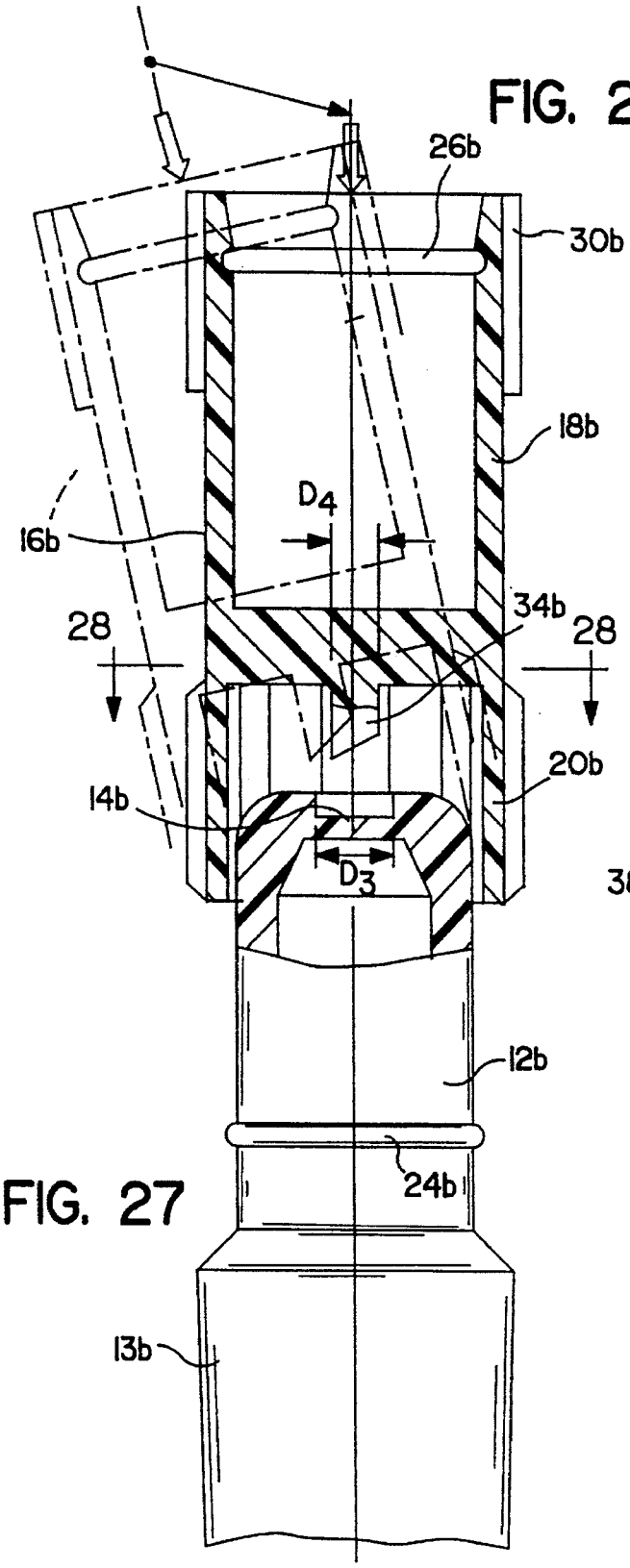
FIG. 27 is an enlarged fragmentary elevational view showing the piercing closure applied to the nozzle at an angular disposition.
Figure 28:
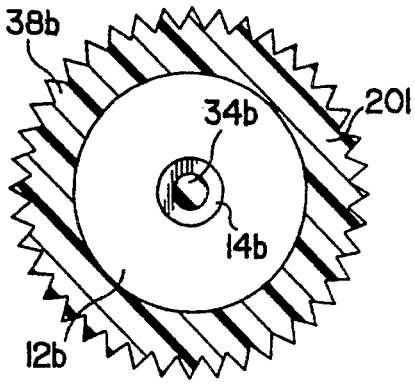
FIG. 28 is a sectional view taken on lines 28—28 of FIG. 27.
Figure 29:
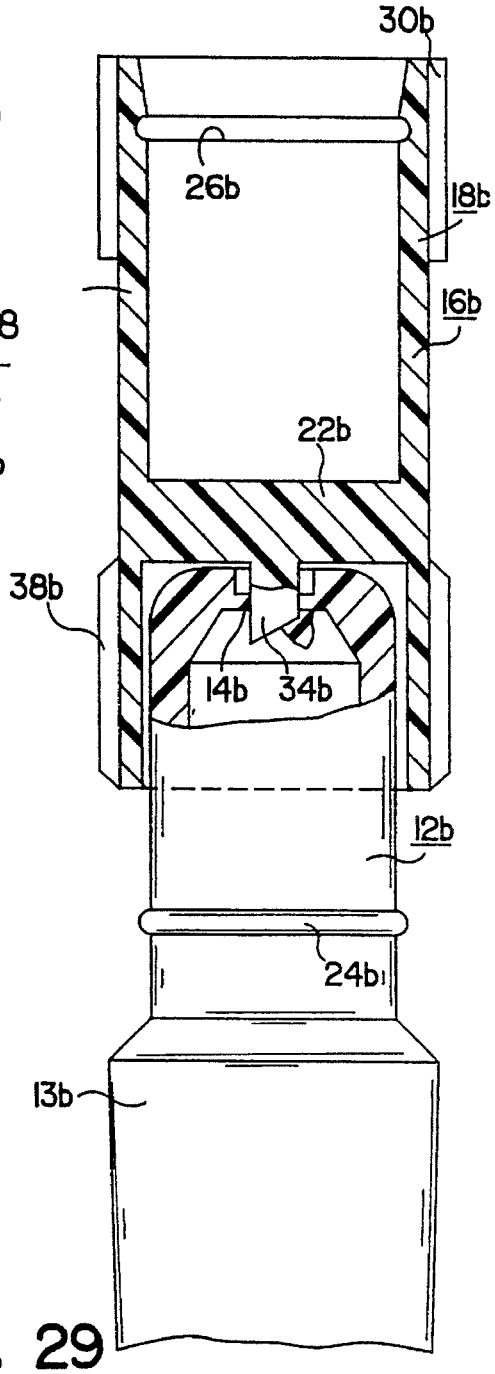
FIG. 29 is a view similar to the previous two views showing the cap fully seated in the piercing diaphragm position.
Figure 30:
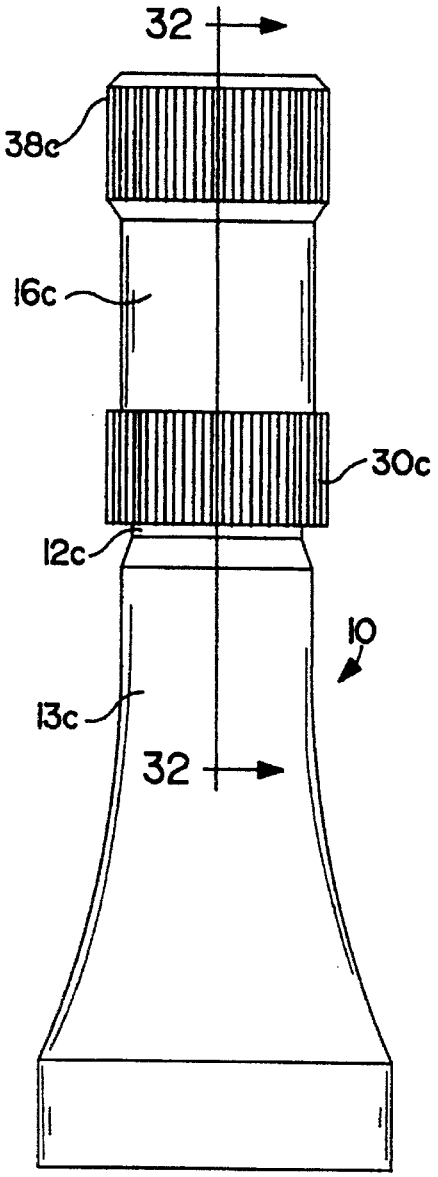
FIG. 30 is a side elevational view of still another embodiment of container-closure assembly in accordance with the present invention.

In accordance with this embodiment of the invention, the nozzle portion has a smooth cylindrical outer periphery and the internal cylindrical walls of the cap portion 18$^b$ and the diaphragm piercing portion 20$^b$ are of a predetermined diameter to provide a snug fit with the nozzle when applied thereto in the manner shown in FIGS. 25 and 29. By reason of this relationship, the piercing element 34 is piloted during application even if presented at an angle so that it engages the diaphragm portion 14$^b$ of the nozzle 12$^b$. In this regard it is noted that the diameter $D_3$ of the diaphragm 14$^b$ is slightly greater than the diameter $D_4$ of the piercing element 34$^b$ to insure engagement of the piercing element and the diaphragm when applying the closure.

There is shown in FIGS. 31–39 inclusive another embodiment of container-closures assembly which is generally similar the previously described embodiments and includes the features inhibiting "spurting" when applying the piercing portion of the closure to the container and is also configured to permit easy application of the closure even at an angle and insure penetration of the piercing element in the diaphragm to achieve the desired easy formation of a discharge opening in generally in the manner described above.

Figure 32:
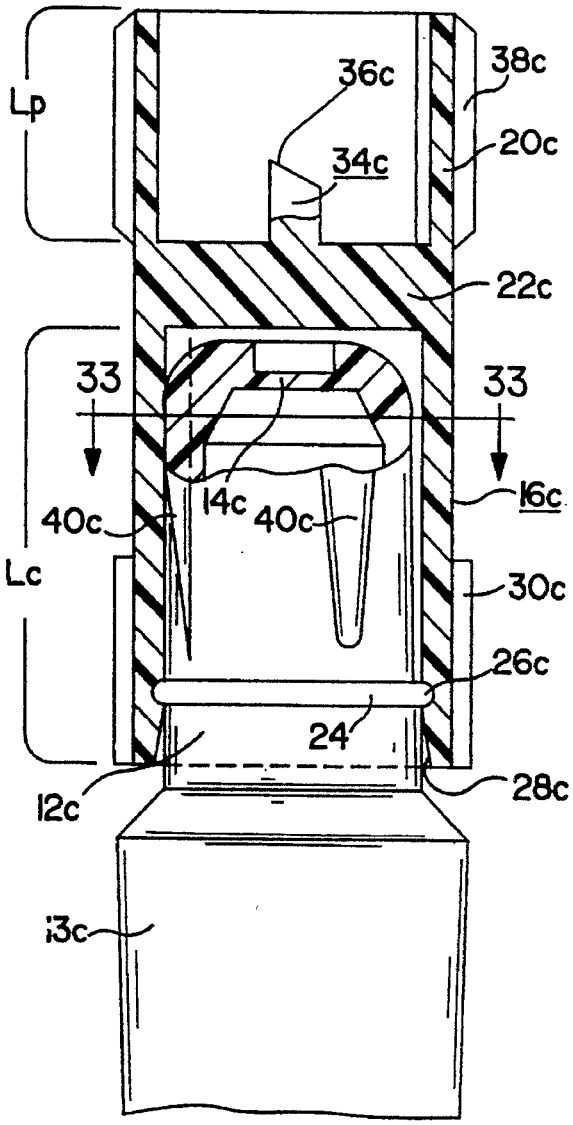
FIG. 32 is an enlarged fragmentary side elevational view partially in section taken on lines 32—32 of FIG. 30.
Figure 31:
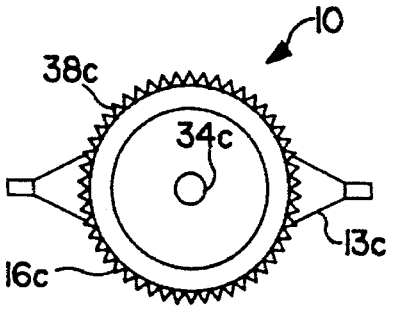
FIG. 31 is a top plan view of the embodiment shown in FIG. 30.
Figure 33:
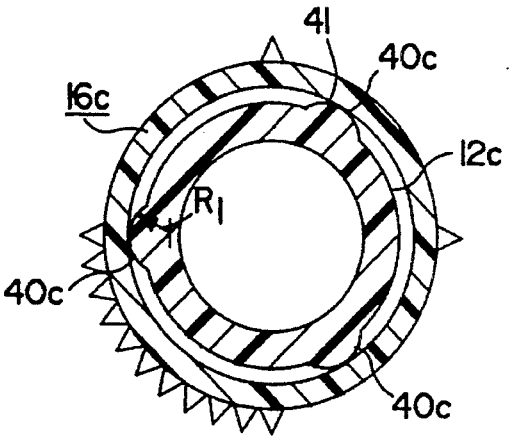
FIG. 33 is a plan sectional view taken on lines 33—33 of FIG. 32.
Figure 34:
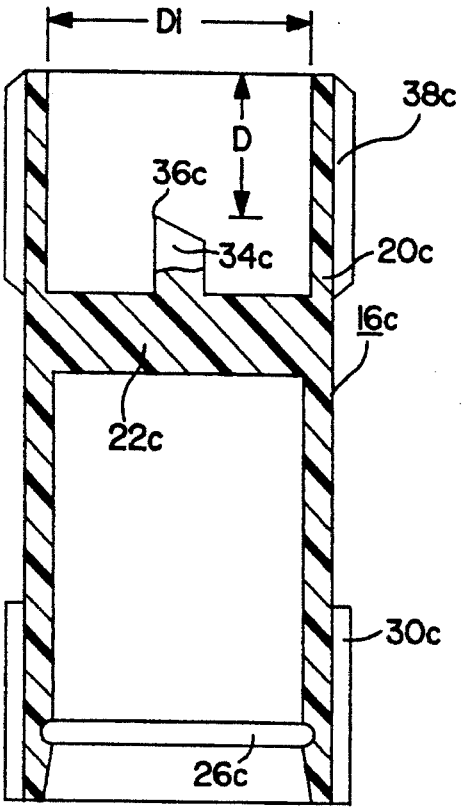
FIG. 34 is a sectional elevational view of the closure for the embodiment of FIG. 30.
Figure 36:
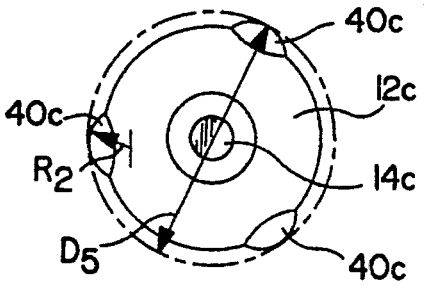
FIG. 36 is a plan view taken on the line 36—36 of FIG. 35.
Figure 35:
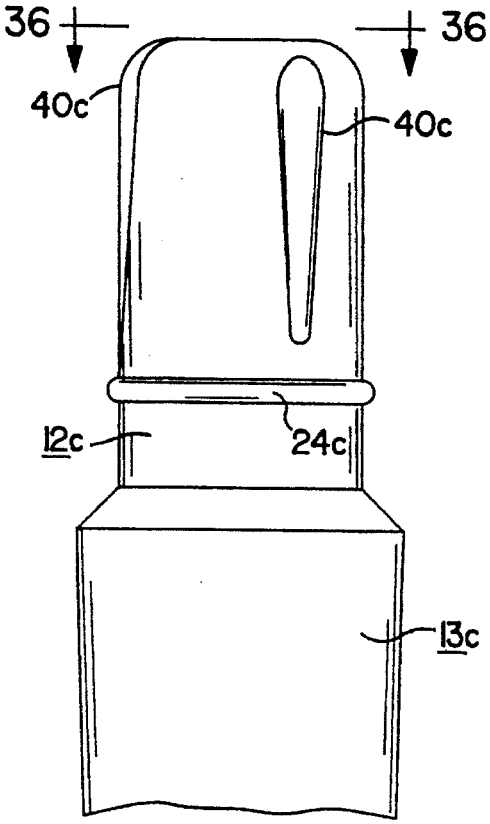
FIG. 35 is a side elevational view of the nozzle portion of the container of FIG. 30.
Figure 37:
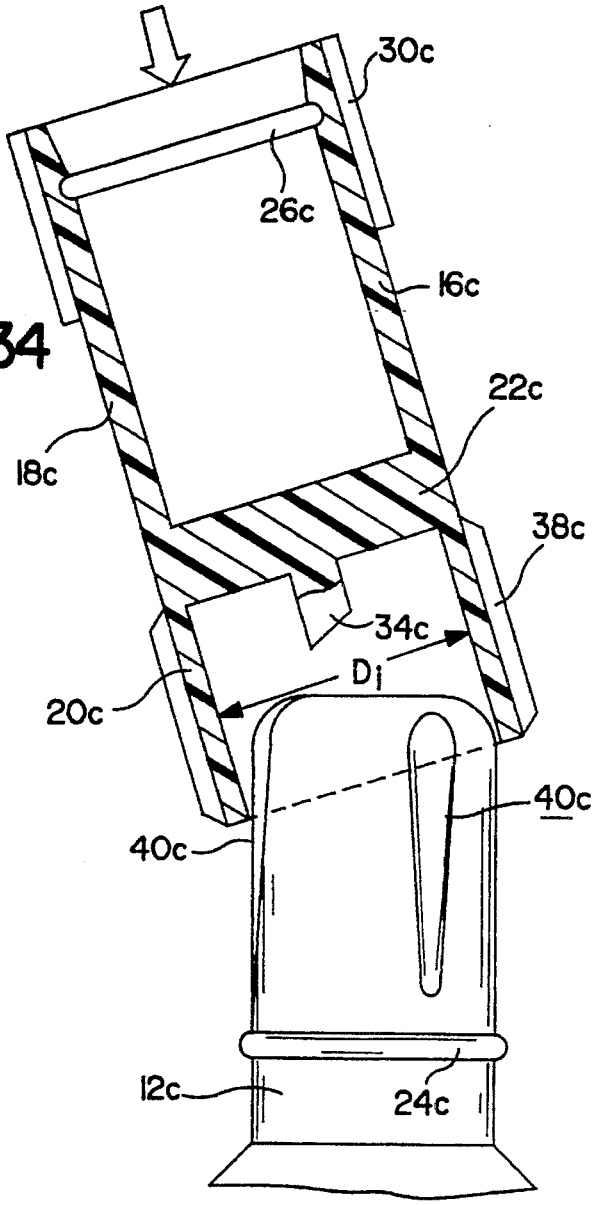
FIG. 37 is an enlarged fragmentary elevational view showing the piercing closure applied to the nozzle at an angular disposition.
Figure 38:
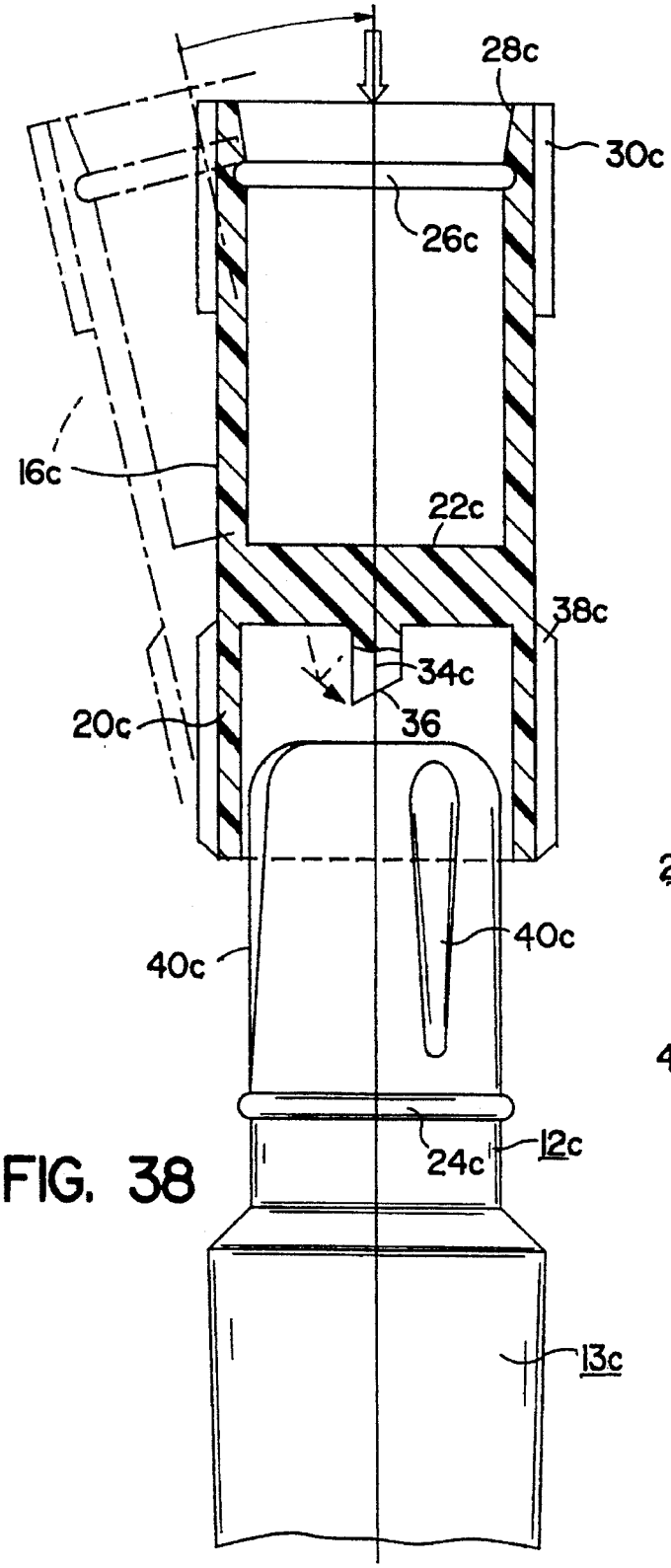
FIG. 38 is an enlarged fragmentary elevational view showing the piercing closure applied to the nozzle at an angular disposition as shown in dot and dash line and being rotated into axial alignment with the nozzle axis, shown in full line in order to push the closure down the nozzle into piercing engagement with the nozzle diaphragm.
Figure 39:
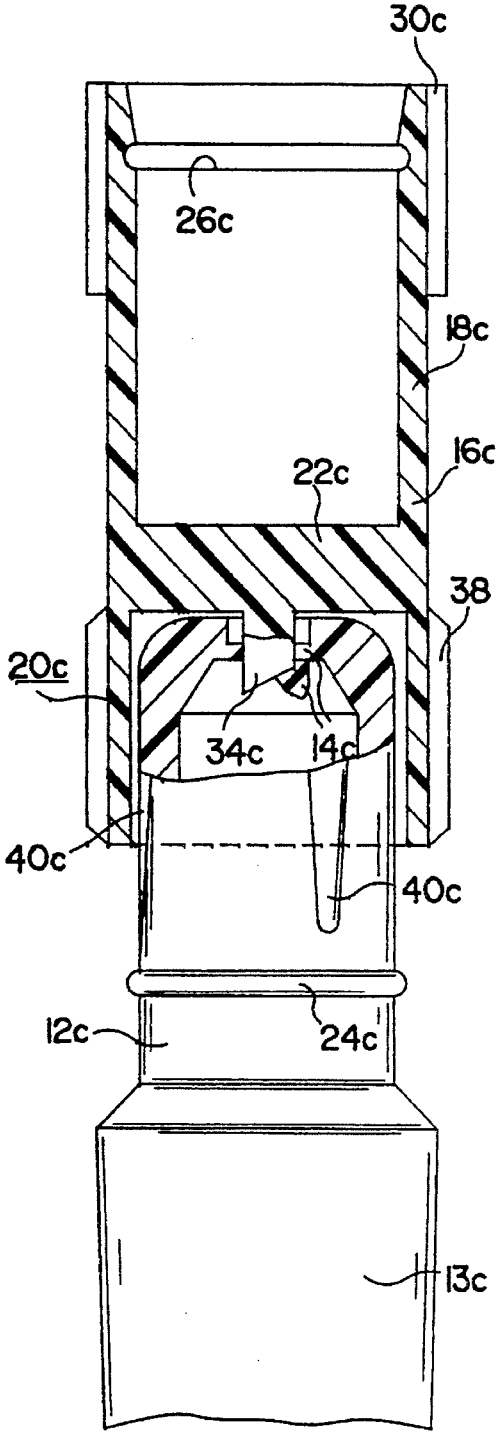
FIG. 39 is a view similar to the previous two views showing the cap fully seated in the piercing diaphragm position.

Thus the container 13$^c$ has a nozzle portion 12$^c$ terminating in a diaphragm 14$^c$. In accordance with this embodiment, the nozzle is provided with a series of circumferentially spaced radially outwardly ribs 40$^c$. In the present instance, the interior walls of the cap portion and the piercing portion are smooth sided and of a predetermined diameter relative to the circumferential trace of the ribs to provide a snug fit with the nozzle when the closure applied either initially as shown in FIG. 32 or during a piercing operation as shown in FIG. 39. More specifically, the diameter $D_5$ of a circumferential trace through the peaks of the ribs 40$^c$ is preferably only slightly smaller than the internal diameter $D_i$ of the piercing portion.

In accordance with the present invention, if the closure is presented to the nozzle at some angular disposition, the closure needs to align its axial center line with the axial center line of the nozzle in order to be advanced further down the nozzle by reason of the fact that the inner diameter $D_i$ of the cup 20 in its relationship to the trace diameter of the ribs and also the depth $L_p$ of the cup 20, thus the piercing point 34 is axially aligned with the diaphragm before reaching it.

Even though particular embodiments of the present invention have been illustrated and described herein it is not intended to limit the invention and changes and modifications may be made therein within the scope of the following claims:

What is claimed is:

1. A container-closure assembly comprising a container having a nozzle portion with a puncturable diaphragm defining a discharge opening and a closure including a piercing portion of generally cup-like form positionable over the nozzle and having a piercing element recessed in the piercing portion of the closure of a predetermined axial length less than the diameter of the piercing portion; and a plurality of axially extending circumferentially spaced ribs on the exterior surface of the nozzle portion and a plurality of circumferentially spaced grooves on the interior wall of the piercing portion to provide interengaging guide means when applying the piercing portion over the nozzle portion to pierce the diaphragm, the number of the circumferentially spaced grooves on the interior wall of the piercing portion being twice the number of ribs on the exterior surface of the nozzle portion spaced relative to one another so that the ribs on the exterior surface of the nozzle portion engage with selective ones of the grooves in the piercing portion when applying the piercing portion over the nozzle portion of the container.

2. A container-closure assembly as claimed in claim 1, wherein said closure comprises a cap portion and a diaphragm piercing portion both of generally of cup-like form separated by a center wall and wherein the nozzle and the cap portion are provided with interengaging locking means.

3. A container-closure assembly as claimed in claim 2, wherein the interengaging locking means comprises a radially outwardly directed circumferentially extending rib on the exterior surface of the nozzle portion and a circumferentially extending mating groove on the interior surface of the cap portion.

4. A container-closure assembly as claimed in claim 1, wherein the tip of the piercing clement is spaced inwardly from a plane through the lower terminal edge of the piercing portion a predetermined distances equal to at least one half the inner diameter of the open end of the piercing portion of the closure.

5. A container-closure is claimed in claim 1, wherein the ribs and grooves are of generally square cross-section.

6. A container-closure assembly as claimed in claim 1, wherein the outer surface of the piercing portion is knurled to provide a gripping means.

7. A container-closure assembly comprising a container having a nozzle portion with a puncturable diaphragm defining a discharge opening and a closure including a piercing portion of generally cup-like form positionable over the nozzle and having a piercing element recessed in the piercing portion of the closure of a predetermined axial length less than the diameter of the piercing portion;

a plurality of axially extending circumferentially spaced ribs of generally square cross section on the exterior surface of the nozzle portion and a plurality of circumferentially spaced grooves of generally square cross section on the interior wall of the piercing portion to provide interengaging guide means when applying the piercing portion over the nozzle portion to pierce the diaphragm;

the outer surface of the piercing portion being knurled to provide a gripping means; and the knurling being interrupted at circumferentially spaced locations aligned with the grooves on the interior surface of the piercing portion to facilitate alignment of the grooves with the ribs on the nozzle portion when applying the closure to the container.

8. A container-closure assembly comprising a container having a nozzle portion with a puncturable diaphragm defining a discharge opening and a closure including a piercing portion of generally cup-like form positionable over the nozzle and having a piercing element recessed in the piercing portion of the closure of a predetermined axial length less than the diameter of the piercing portion; and a plurality of axially extending circumferentially spaced ribs on the exterior surface of the nozzle portion and a plurality of circumferentially spaced grooves on the interior wall of the piercing portion to provide interengaging guide means when applying the piercing portion over the nozzle portion to pierce the diaphragm, the radius of the ribs being smaller than the radius of the grooves to produce low friction and point contact between the parts during a piercing operation.

9. A container-closure assembly comprising:

a container having a nozzle portion with a puncturable diaphragm defining a discharge opening;

a closure including a piercing portion of generally cup-like form positionable over the nozzle portion and having a piercing element recessed in the piercing portion of the closure of a predetermined axial length less than the diameter of the piercing portion;

a plurality of axially extending circumferentially spaced ribs of tear drop shape having a rounded top portion on the exterior surface of the nozzle portion which taper inwardly and downwardly relative to the axis of the nozzle and a plurality of circumferentially spaced grooves on the interior wall of the piercing portion to provide interengaging guide means when applying the piercing portion over the nozzle portion to pierce the diaphragm; and said closure including a cap portion of cup-like form positionable over the nozzle portion with a snug fit, said nozzle portion and cap portion having interengaging locking means.

10. A container-closure assembly comprising:

a container having a nozzle portion with a puncturable diaphragm defining a discharge opening and a closure including a piercing portion of generally cup-like form having a predetermined inner diameter positionable over the nozzle and having a solid piercing element recessed in the piercing portion of the closure, the tip of the piercing element being spaced inwardly from a plane through the lower terminal edge of the piercing portion a predetermined distance equal to at least one half said inner diameter of the open end of the piercing portion of the closure; and said container and nozzle portion having a plurality of interengaging ribs and grooves whereby at initial engagement of the piercing portion and nozzle with the ribs and grooves aligned, the tip of the piercing element is spaced from the diaphragm to facilitate centering of the piercing portion relative to the nozzle before piercing action occurs.

11. A container-closure assembly comprising a container having a nozzle portion with a puncturable diaphragm defining a discharge opening and a closure including a piercing portion of generally cup-like form positionable over the nozzle including a piercing element; and a plurality of axially extending circumferentially spaced ribs on the exterior surface of the nozzle portion and a plurality of circumferentially spaced grooves on the interior wall of the piercing portion to provide interengaging guide means when applying the piercing portion over the nozzle portion to pierce the diaphragm, the number of the circumferentially spaced grooves on the interior wall of the piercing portion being twice the number of ribs on the exterior surface of the nozzle portion spaced relative to one another so that the ribs on the exterior surface of the nozzle portion engage with selective ones of the grooves in the piercing portion when applying the piercing portion over the nozzle portion of the container.

12. A container-closure assembly comprising a container having a nozzle portion with a puncturable diaphragm defining a discharge opening and a closure including a piercing portion of generally cup-like form positionable over the nozzle including a piercing element;

a plurality of axially extending circumferentially spaced ribs of generally square cross section on the exterior surface of the nozzle portion and a plurality of circumferentially spaced grooves of generally square cross section on the interior wall of the piercing portion to provide interengaging guide means when applying the piercing portion over the nozzle portion to pierce the diaphragm;

the outer surface of the piercing portion being knurled to provide a gripping means; and the knurling being interrupted at circumferentially spaced locations aligned with the grooves on the interior surface of the piercing portion to facilitate alignment of the grooves with the ribs on the nozzle portion when applying the closure to the container.

* * * * *